US008049124B2

(12) United States Patent
Jang et al.

(10) Patent No.: US 8,049,124 B2
(45) Date of Patent: Nov. 1, 2011

(54) BUTTON FOR CONTROL PANEL ASSEMBLY AND CLOTHES HANDLING APPARATUS HAVING THE SAME

(75) Inventors: Ho-Sung Jang, Gyeongsangnam-Do (KR); Chang-Woo Son, Gyeongsangnam-Do (KR); Gil-Yong Lee, Gyeongsangnam-Do (KR); Yong-Min Jeon, Gyeongsangnam-Do (KR); Han-Ki Cho, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 614 days.

(21) Appl. No.: 12/202,725

(22) Filed: Sep. 2, 2008

(65) Prior Publication Data

US 2009/0057117 A1 Mar. 5, 2009

(30) Foreign Application Priority Data

Sep. 3, 2007 (KR) ..... 10-2007-0089180

(51) Int. Cl.
*H01H 13/02* (2006.01)

(52) U.S. Cl. ..... 200/314; 200/5 A

(58) Field of Classification Search ..... 200/5 A, 200/341, 314, 296, 519, 520
See application file for complete search history.

(56) References Cited

U.S. PATENT DOCUMENTS 6,495,782 B1 * 12/2002 Huang ..... 200/341
7,294,794 B2 * 11/2007 Choi et al. ..... 200/5 A
7,875,816 B2 * 1/2011 Yoon et al. ..... 200/5 A
2009/0133448 A1 * 5/2009 Yoon et al. ..... 68/13 R
2010/0139329 A1 * 6/2010 Yoon et al. ..... 68/139

FOREIGN PATENT DOCUMENTS

DE 195 05 485 A1 8/1996
DE 100 29 417 A1 8/2001
KR 10-2006-0120943 A 11/2006
WO WO 2006/038147 A2 4/2006
WO WO 2007/073049 A1 6/2007

OTHER PUBLICATIONS

European Search Report dated Feb. 2, 2009.
Korean Office Action dated Feb. 27, 2009.

* cited by examiner

*Primary Examiner* — Renee Luebke
*Assistant Examiner* — Marina Fishman
(74) *Attorney, Agent, or Firm* — KED & Associates, LLP

(57) ABSTRACT

Disclosed are a button for a control panel assembly and a clothes handling apparatus having the same. In a control panel assembly comprising a control panel having button holes to mount a plurality of buttons and a display window, at least one of the buttons comprises a pressing portion having an optical diffusion portion for diffusing light occurring from a light source disposed at a back of the buttons; a mounting portion for fixing the buttons to a back of the control panel; and a supporting portion for connecting the pressing portion and the mounting portion to each other, and providing an elastic force to the pressing portion. According to this configuration, a larger amount of light occurring from the light source is emitted to a front of the buttons, and a user's convenience is enhanced.

16 Claims, 4 Drawing Sheets

【Fig. 1】
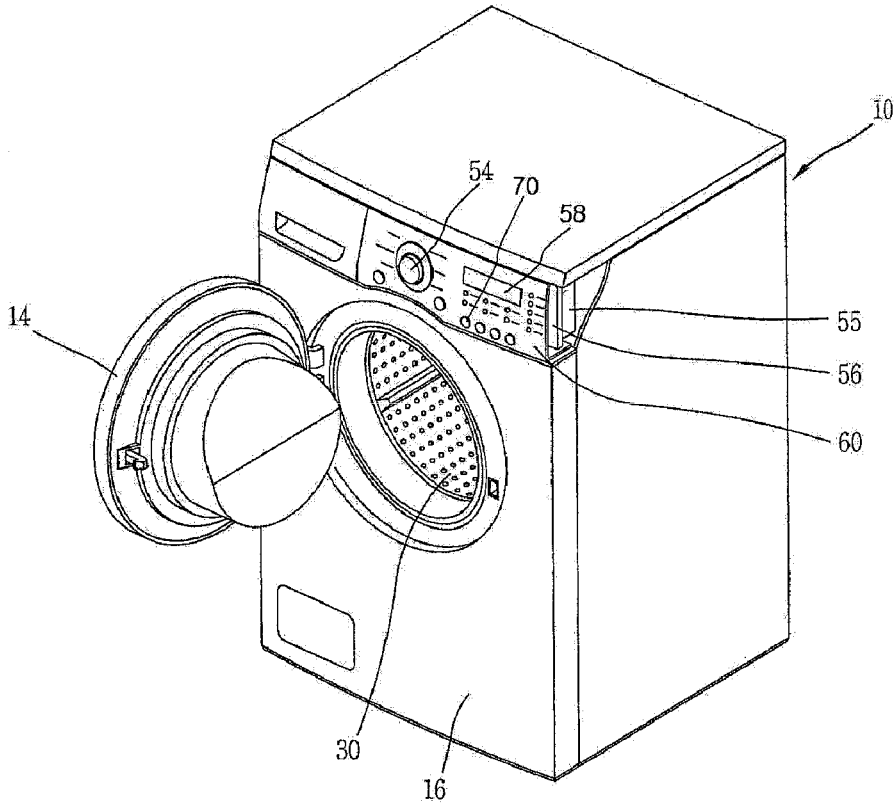
【Fig. 2】
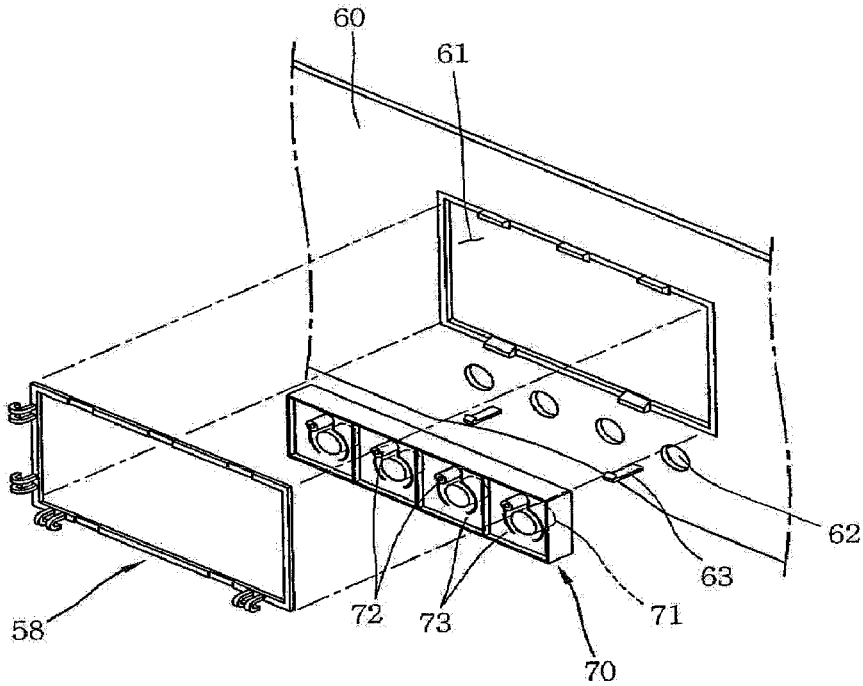

【Fig. 3】
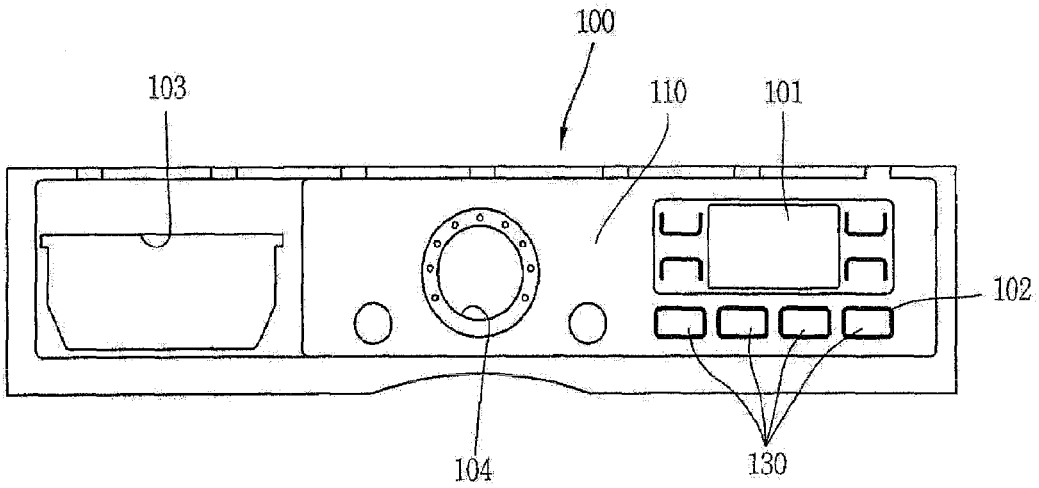
【Fig. 4】
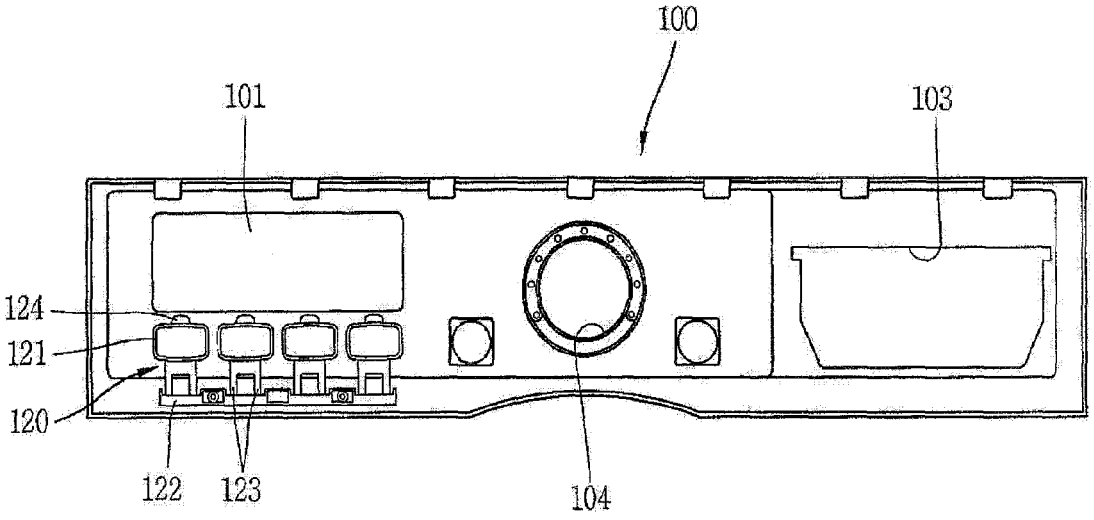

【Fig. 5】
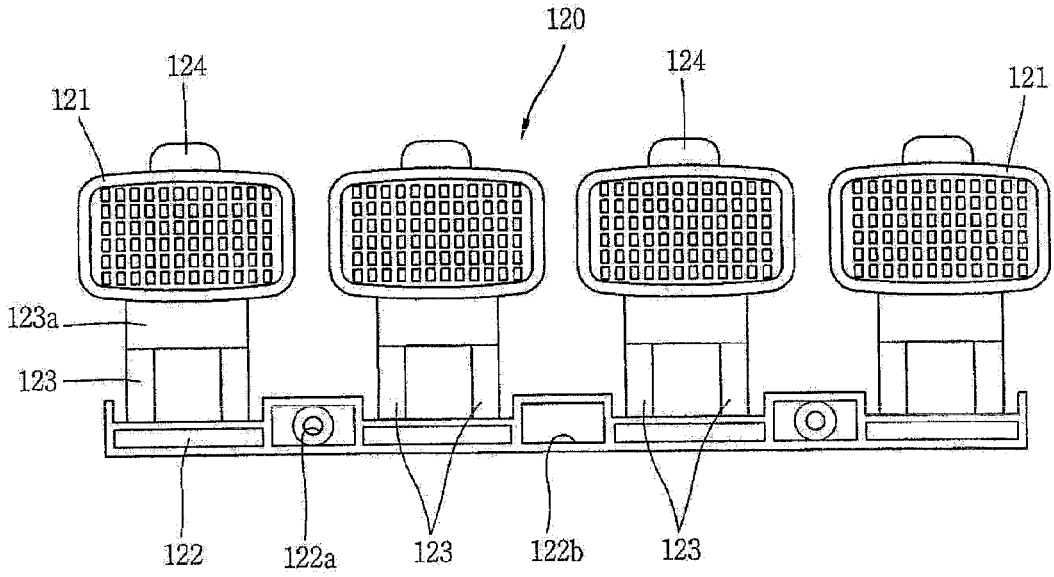
【Fig. 6】
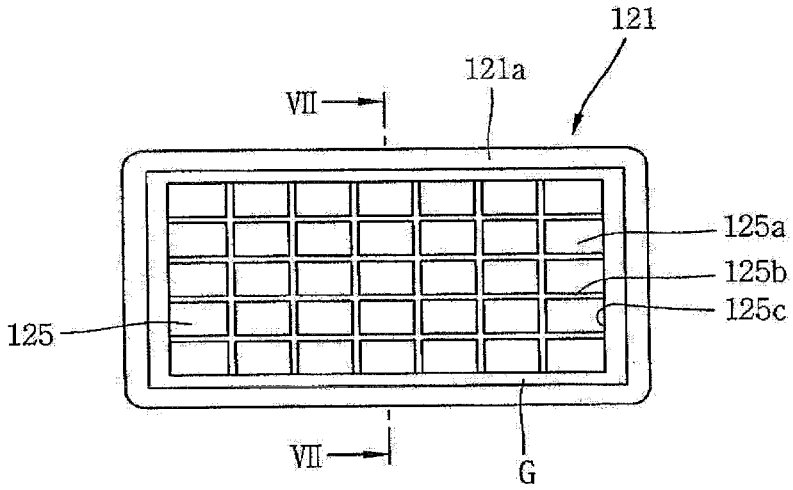

【Fig. 7】
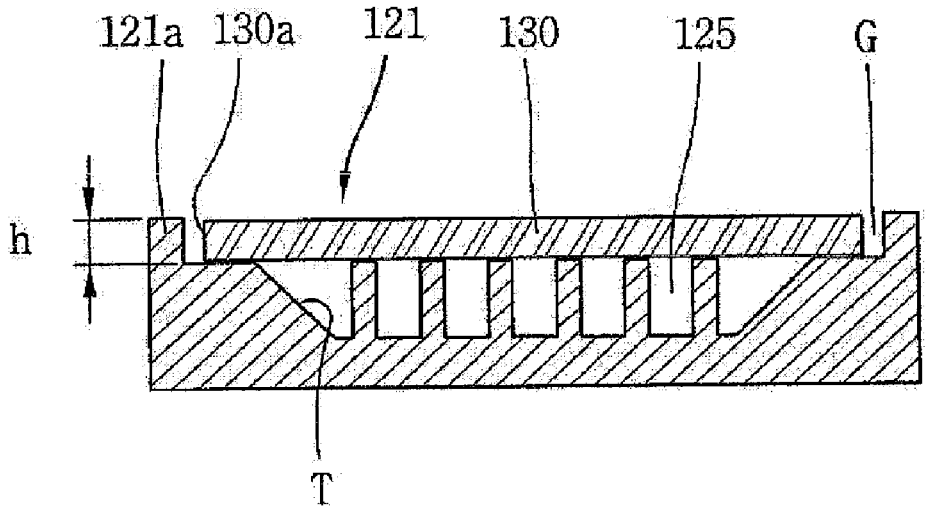
【Fig. 8】
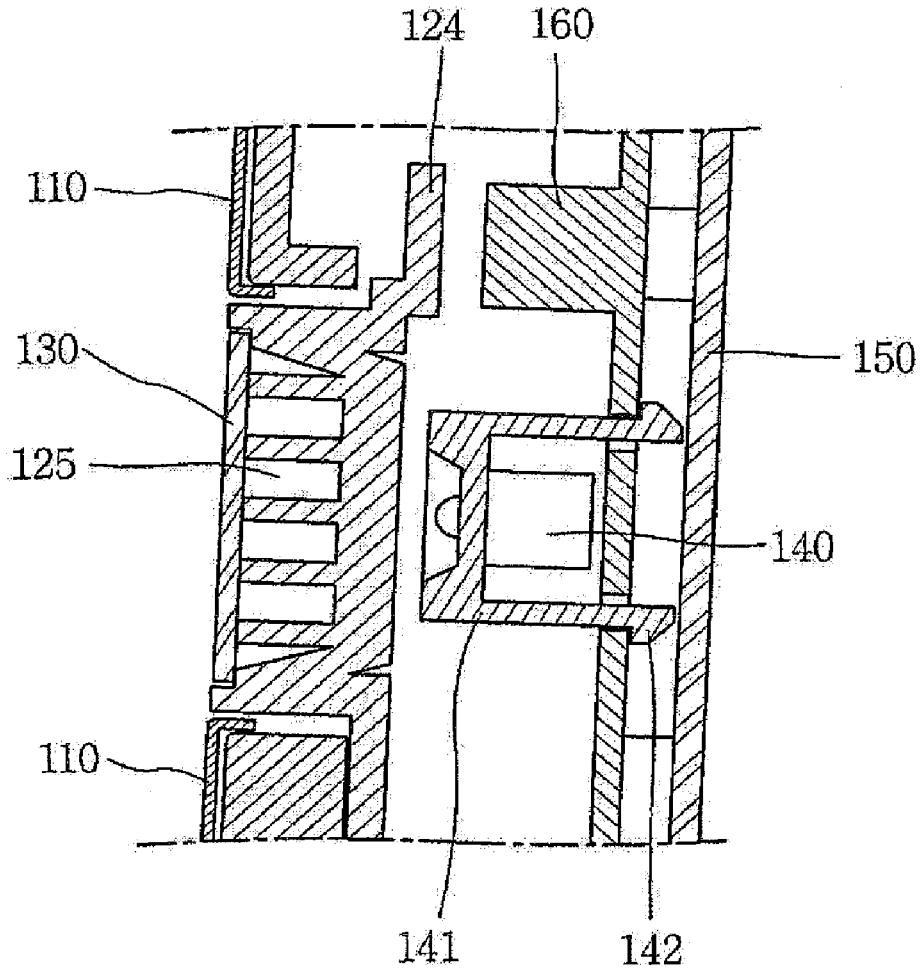

BUTTON FOR CONTROL PANEL ASSEMBLY AND CLOTHES HANDLING APPARATUS HAVING THE SAME

RELATED APPLICATION

The present invention relates to subject matter contained in priority Korean Application 10-2007-0089180, filed Sep. 3, 2007, which is herein expressly incorporated by reference in its entirety.

BACKGROUND OF THE INVENTION

1. Field of the Invention

The present invention relates to a control panel assembly, and more particularly, to a button for a control panel assembly having an optical diffusion unit of a lattice structure for forwardly diffusing light occurring from a light source, and a clothes handling apparatus having the same.

2. Description of the Background Art

Generally, a clothes handling apparatus includes a washing machine, a clothes drier, a refresher, etc.

Among the various clothes handling apparatuses, a drum type washing machine will be explained.

The drum type washing machine serves to perform a washing process by using a frictional force between laundry and a drum that rotates by receiving a driving force of a motor, under a state that detergent, washing water and laundry are input into the drum. Demands for the drum type washing machine are increased since laundry is scarcely damaged, laundry is not entangles to each other, and effects such as biting and rubbing are obtainable.

FIG. 1 is a perspective view of a general drum type washing machine, and FIG. 2 is an exploded perspective view of buttons of a control panel of FIG. 1.

The drum type washing machine comprises a cabinet 10 that forms the appearance thereof, a tub (not shown) installed in the cabinet 10, and a drum 30 rotated in the tub and having laundry inputted thereinto.

A front cover 16 is mounted to a front surface of the cabinet 10, and a door 14 for opening and closing the drum 30 is mounted to an approximate middle portion of the front cover 16. At an upper part of the front cover 16, attached is a control panel 60 mounted with a manipulating portion for inputting washing conditions, a display portion 58 for displaying the current operation status of the drum type washing machine, etc. Each kind of a control substrate 56 and a control frame 55 is mounted in the control panel 60.

The manipulating portion for inputting washing conditions is implemented as a button 70, or a dial knob 54 rotated by a user's hand.

Referring to FIG. 2, the control panel 60 includes a display portion mounting hole 61 for mounting the display portion 58, and a button mounting hole 62 for mounting the button 70.

The button 70 includes a pressing portion 72 directly pressed by a user, and an elastic portion 73 for restoring the pressed pressing portion 72 to the original position. The button 70 is fixed by a fixing hook 63 formed in the control panel 60.

Recently, a button illuminated when pressed to inform a user of the pressed state is spotlighted.

However, when light occurring from a light source such as a light emitting diode (LED) disposed at a back of the button 70 passes through a flat surface of the button 70, the amount of light is reduced to cause a user not to precisely detect the pressed state of the button 70. As a result, the control panel 60 has a degraded appearance.

Furthermore, when the button 70 is fixed to the fixing hook 63 of the control panel 60 with a non-uniform force, the button 70 is not properly mounted. Besides, while the button is mounted to the fixing hook 63 and the drum type washing machine is used, the fixing hook 63 may be damaged to cause the button 70 to be detached from the original position.

Furthermore, the button does not match a drum type washing machine having a cabinet formed of stainless steel and providing a sophisticated image.

SUMMARY OF THE INVENTION

Therefore, it is an object of the present invention to provide a button for a control panel assembly including a control panel having button holes to mount a plurality of buttons and a display window, wherein at least one of the buttons comprises: a pressing portion having an optical diffusion portion for diffusing light occurring from a light source disposed at a back of the buttons; a mounting portion for fixing the buttons to a back of the control panel; and a supporting portion for connecting the pressing portion and the mounting portion to each other, and providing an elastic force to the pressing portion.

As the optical diffusion portion is formed at the pressing portion of the button, an amount of optical transmittance is increased, and a diffusion degree of light is enhanced.

Here, the optical diffusion portion has a lattice structure having a plurality of cavities at a front surface of the pressing portion. As the optical diffusion portion is formed to have a lattice structure, a plate-shaped member can be further attached onto the optical diffusion portion, and light can be effectively diffused.

An outline to encompass the optical diffusion portion is formed at a rim of the pressing portion, and an edge of the optical diffusion portion is spaced from the outline by a certain gap. If an optical shielding member is additionally attached onto the optical diffusion portion, light passes through only the gap between the edge of optical diffusion portion and the outline.

Preferably, the optical diffusion portion is more concaved than the outline, which prevents the optical shielding member attached onto the optical diffusion portion from being more protruding than the outline of the pressing portion.

Preferably, the edge of the optical diffusion portion is formed to be tapered toward a bottom surface of the pressing portion. That is, as the optical diffusion portion is tapered so as to have a relatively enlarged front surface, an optical diffusion effect can be more enhanced.

As aforementioned, an optical shielding member formed of stainless steel and shielding a part of light having passed through the optical diffusion portion may be further formed on a front surface of the pressing portion. An edge of the optical shielding member is spaced from an outline of the pressing portion. The optical shielding member is attached onto a front surface of the pressing portion by a double-sided tape.

A switch contact portion for pressing a switch disposed at a back of the pressing portion when the pressing portion is pressed may be further formed at one side of the pressing portion. This is in order to interwork an on/off operation of a tact switch disposed at a back of the buttons with a pressing operation of the pressing portion.

To achieve these and other advantages and in accordance with the purpose of the present invention, as embodied and broadly described herein, there is also provided a clothes handling apparatus having a control panel assembly comprising: a plurality of buttons for selecting each kind of functions;

a display for displaying each kind of information; a control panel having a plurality of button holes for mounting the plurality of buttons, and a display window for installing the display; and a circuit board disposed in the control panel and processing control signals inputted through the buttons, wherein at least one of the buttons comprises: a pressing portion having an optical diffusion portion for diffusing light occurring from a light source disposed at a back of the buttons; a mounting portion for fixing the buttons to components mounted to a back of the control panel; and a supporting portion for connecting the pressing portion and the mounting portion to each other, and providing an elastic force to the pressing portion.

The clothes handling apparatus may further comprise an optical shielding member formed of stainless steel, and shielding a part of light occurring from a light source installed at a back of the pressing portion.

Here, function characters indicating functions of the clothes handling apparatus that can be selected by a user are displayed on the surface of the optical shielding member, and the function characters are penetratingly formed at the optical shielding member. More concretely, as the function characters are penetratingly formed at the optical shielding member by an etching process, etc., light having passed through the optical diffusion portion is made to pass through the function characters. Accordingly, a user can precisely recognize a selected function, and visual effects can be enhanced.

A switch contact portion for pressing a switch disposed at a back of the pressing portion when the pressing portion is pressed may be further formed at one side of the pressing portion.

According to another aspect of the present invention, there is provided a clothes handling apparatus having a control panel assembly comprising: a plurality of buttons for selecting each kind of functions; a display for displaying each kind of information; a control panel having a plurality of button holes for mounting the plurality of buttons, and a display window for installing the display; and a circuit board disposed in the control panel and processing control signals inputted through the buttons, wherein at least one of the buttons comprises: a pressing portion having an optical diffusion portion for diffusing light occurring from a light source disposed at a back of the buttons; a mounting portion for fixing the buttons to components mounted to a back of the control panel; and a supporting portion for connecting the pressing portion and the mounting portion to each other, and providing an elastic force to the pressing portion, wherein other parts rather than a gap between an outline to encompass the optical diffusion portion and an edge of the optical diffusion portion are covered with stainless steel.

Under this configuration, the clothes handling apparatus having the appearance of stainless steel can match the a button for a control panel assembly.

The present invention is to provide a button for a control panel assembly installed at a clothes handling apparatus, wherein the button comprises an optical diffusion portion of a lattice structure having a plurality of cavities formed at a front surface of the button so as to diffuse light occurring from a light source disposed at a back of the button.

Since the optical diffusion portion for transmitting light having passed through the button to a front of the button without an optical loss, a larger amount of light from the light source can be emitted toward the front of the button. This enhances a user's convenience.

The present invention is also to provide a button for a control panel assembly capable of reducing buttons from being detached from a mounting portion even when being used for a long time by mounting the buttons to the mounting portion by an additional coupling means such as screws, and a clothes handling apparatus having the same.

Furthermore, the present invention provides a button for a control panel assembly having the appearance that can match a clothes handling apparatus having the appearance of stainless steel, which allows the clothes handling apparatus to have sophisticated and aesthetic feeling.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a perspective view of a general drum type washing machine;

FIG. 2 is an exploded perspective view of buttons of a control panel of FIG. 1;

FIG. 3 is a front view of a control panel assembly according to a first embodiment of the present invention;

FIG. 4 is a rear view of the control panel assembly of FIG. 3;

FIG. 5 is a view of buttons for the control panel assembly of FIG. 3;

FIG. 6 is an enlarged view of a pressing portion of the buttons of FIG. 5;

FIG. 7 is a sectional view taken along line 'VII-VII' of FIG. 6; and

FIG. 8 is a sectional view schematically showing a reciprocal relation between the pressing portion of FIG. 6 and a light source.

DETAILED DESCRIPTION OF THE INVENTION

Reference will now be made in detail to the preferred embodiments of the present invention, examples of which are illustrated in the accompanying drawings.

Hereinafter, the structure and operation of a first embodiment of the present invention will be explained in more detail. The following explanation shows several patentable aspects of the present invention, and the following description constitutes a part of the detailed description of the present invention.

Detailed explanation about well-known functions or structures will be omitted so as to implement the present invention more distinctly.

Hereinafter, a drum type washing machine, one of clothes handling apparatuses will be explained for convenience. The drum type washing machine has the same configuration as the drum type washing machine of FIG. 1 except for a control panel assembly, and thus its detailed explanation will be omitted.

FIG. 3 is a front view of a control panel assembly according to a first embodiment of the present invention, and FIG. 4 is a rear view of the control panel assembly of FIG. 3.

As shown in FIG. 3, a control panel assembly 100 for a drum type washing machine according to a first embodiment of the present invention includes a control panel 110 attached onto an upper part of a front surface of the drum type washing machine. On the control panel 110, mounted are a display window 101 for a display that displays each kind of information, button holes 102 for mounting buttons, a detergent box mounting opening 103, and a dial knob mounting opening 104.

An optical shielding member 130 on which each kind of functions are displayed may be attached onto the button holes 102.

Referring to FIG. 4, buttons 120 composed of four pressing portions 121 as one component are installed below the display window 101 of a rear surface of the control panel 110.

Each of the buttons 120 include a pressing portion 121 directly pressed by a user, a mounting portion 122 for fixing the buttons 120 to a back of the control panel 110, a supporting portion 123 for connecting the pressing portion 121 and the mounting portion 122 to each other, and providing an elastic force to the pressing portion 121. Here, the supporting portion 123 serves to restore the pressing portion 121 pressed by a user to the original state or the original position.

A detailed structure of the buttons 120 will be explained in more detail with reference to FIGS. 5 to 7.

FIG. 5 is a view of buttons for the control panel assembly of FIG. 3, FIG. 6 is an enlarged view of a pressing portion of the buttons of FIG. 5, and FIG. 7 is a sectional view taken along line 'VII-VII' of FIG. 6.

Referring to FIG. 5, a mounting portion 122 having a nearly straight line shape is provided at a lower part of the buttons, and a plurality of supporting portions 123 are integrally provided with a certain gap from the mounting portion 122. The pressing portion 121 is respectively formed at each upper end of the supporting portions 123.

A plurality of coupling member mounting openings 122*a* are mounted at the mounting portion 122, and a cavity for mounting a head of a coupling member may be further formed at the periphery of the coupling member mounting openings 122*a*.

An interference preventing hole 122*b* for preventing interference with other electric components mounted to the control panel 110 that covers the buttons 120 may be formed.

Preferably, the supporting portion 123 is formed to have a cantilever shape that one end thereof is fixed to the mounting portion 122. That is, the supporting portion 123 of a cantilever shape has one end serving as a fixed end by being fixed to the mounting portion 122, and another end having the pressing portion 121 and serving as a free end. The free end of the supporting portion 123 serves to allow the pressing portion 121 to be pressed or to be restored to the original state.

The supporting portion 123 may be formed in one or at least two in number with respect to one pressing portion 121. Most preferably, the supporting portion 123 is formed in two with consideration of installation status of other electric components inside the control panel 110, or a necessary elastic restoration force.

A stepped portion 123*a* is formed at a connected part between the supporting portion 123 and the pressing portion 121. Since the pressing portion 121 has a predetermined thickness, the stepped portion is preferably formed when the supporting portion 123 is connected to a lower end of the pressing portion 121.

The pressing portion 121 has a nearly square shape, and has an area large enough to be easily pressed by a user. The supporting portion 123 is connected to a lower end of the pressing portion 121, and a switch contact portion 124 is formed at an upper end of the pressing portion 121.

Here, the switch contact portion 124 may not be formed. When a tact switch, etc. are installed at a back of the pressing portion 121, the pressing portion 121 may directly press the tact switch thereby not requiring the switch contact portion 124.

However, when a light source such as a light emitting diode (LED) for generating light is installed at a back of the pressing portion 121, a switch such as a tact switch has to be installed as another part rather than a back of the pressing portion 121. Furthermore, the switch contact portion 124 for pressing the switch has to be separately formed from the pressing portion 121. An optical diffusion portion 125 for forwardly diffusing light occurring from the light source disposed at a back of the button 120 or the pressing portion 121 may be formed at the pressing portion 121.

As shown in FIG. 6, the optical diffusion portion 125 is formed at an upper part of the pressing portion 121, and a front surface of the pressing portion 121 has a lattice structure having a plurality of cavities. The lattice structure may be implemented so as to have not only a square shape, but also a hexagonal shape or hive shape. The lattice structure may have a plurality of circular shapes.

The optical diffusion portion 125 of the lattice structure includes cavities 125*a* of an upper end, and barriers 125*b* formed between the cavities 125*a*. Light is forwardly transmitted through the cavities 125*a* of the optical diffusion portion 125, and some of the light is scattered by the barriers 125*b*, thereby providing light which is not too strong to a user.

In order for light occurring from the light source to pass through the pressing portion 121, the pressing portion 121 and the optical diffusion portion 125 have to be formed of transparent or semi-transparent materials. Most preferably, the buttons 120 having the optical diffusion portion 125 of a lattice structure are formed by an injection molding method.

An outline 121*a* to encompass the optical diffusion portion 125 is formed at the pressing portion 121, and an edge 125*c* of the optical diffusion portion 125 is spaced from the outline 121*a* by a certain gap.

The edge 125*c* of the optical diffusion portion 125 is inclined toward a lower end of the pressing portion 121. More concretely, as shown in FIG. 7, the edge 125*c* of the optical diffusion portion 125 is formed to have a tapered portion (T) toward a bottom surface of the pressing portion 121. Here, the tapered portion (T) has a sectional area gradually increased toward an upper end of the pressing portion 21 from a lower end of the pressing portion 121. This is in order to effectively diffuse light from a back of the pressing portion 121 to a front of the pressing portion 121.

The optical diffusion portion 125 is more concaved than the outline 121*a* of the pressing portion 121. That is, as shown in FIG. 7, the optical diffusion portion 125 is formed with a height (h) from the end of the outline 121*a* of the pressing portion 121. As the optical diffusion portion 125 is more concaved than the outline 121*a* of the pressing portion 121, the plate-shaped optical shielding member 130 having a predetermined thickness may be attached onto the pressing portion 121 or the optical diffusion portion 125.

If the optical shielding member 130 is attached onto the pressing portion 121 or the optical diffusion portion 125 under a state that the outline 121*a* and the optical diffusion portion 125 have the same height, the optical shielding member 130 is more protruding than the surface of the pressing portion 121 or the optical diffusion portion 125. This may degrade the entire appearance of the control panel assembly 100.

Here, the optical shielding member 130 is formed of a metallic material, preferably, stainless steel, and shields some of light having passed through the optical diffusion portion 125.

The optical shielding member 130 is attached onto the front surface of the pressing portion 121 due to the following reasons. A first reason is in order to prevent a user directly pressing the pressing portion 121 having the optical diffusion portion 125 of a lattice structure from having uncomfortable feeling (e.g., pain on the end of a finger). A second reason is in order to display functions of the pressing portion 121 on the surface of the optical shielding member 130 thereby to enhance a user's convenience.

An edge 130*a* of the optical shielding member 130 is spaced from the outline 121*a* of the pressing portion 121 by a predetermined gap (G). Light from the light source passes through the gap (G).

The optical shielding member 130 is attached onto a front surface of the pressing portion 121 or the optical diffusion portion 125 by a double-sided tape. However, other adhesion means rather than the double-sided tape may be used. Here, other adhesion means have to be selected with consideration that the entire appearance of the control panel assembly 100 is degraded when the optical shielding member 130 is more protruding from the outline 121*a* of the pressing portion 121.

As aforementioned, function characters indicating each kind of functions of the clothes handling apparatus such as a drum type washing machine are displayed on the surface of the optical shielding member 130, thereby enhancing a user's convenience. Here, the function characters may be printed onto the surface of the optical shielding member 130. However, in order to precisely inform a user of a function selected by the user by using light occurring from the light source, or in order to enhance the appearance of the control panel assembly 100, the function characters may be penetratingly formed at the optical shielding member 130.

When the function characters are penetratingly formed at the optical shielding member 130 by an etching process, etc., light occurring from the light source disposed at a back of the optical diffusion portion 125 is transmitted to a front of the control panel 110 through the function characters. Accordingly, the pressing portion 121 of a button corresponding to a function selected by a user is illuminated.

Furthermore, when a body of the clothes handling apparatus such as a drum type washing machine is not formed of stainless steel, the optical shielding member 130 may be also formed of other materials rather than stainless steel. Also, when the optical shielding member 130 is formed of transparent or semi-transparent resins, visual effects due to light from the light source may be obtained even if function characters are not penetratingly formed at the optical shielding member 130.

FIG. 8 is a sectional view schematically showing a reciprocal relation between the pressing portion of FIG. 6 and the light source. Referring to FIG. 8, the light source 140 is disposed at a back of the pressing portion 121, and installed at a substrate 150 of the control panel assembly 100.

As the light source 140, a light emitting diode (LED), etc. are mounted to the substrate 150 by a light source guide 141. For convenience of the mounting of the light source 140, a coupling hook 142 is preferably formed at the end of the light source guide 141.

A tact switch 160 is installed at a back of the switch contact portion 124 formed at an upper end of the pressing portion 121. Not only the tact switch 160 but also a dome switch, etc may be used.

Recently, a clothes handling apparatus implemented as a body formed of stainless steel for a sophisticated design is being presented. Here, once the optical shielding member 130 formed of stainless steel is attached to the clothes handling apparatus, the entire appearance is enhanced with a sophisticated image. The reason is because other parts rather than a gap (G) between the outline 121*a* formed at a rim of the pressing portion 121 and encompassing the optical diffusion portion 125 and the edge 125*c* of the optical diffusion portion 125 are formed of stainless steel.

The pressing portion 121 may serve as one button without an additional supporting portion or a mounting portion. In this case, the optical diffusion portion 125 of a lattice structure having a plurality of cavities may be formed on a front surface of the pressing portion 121 so as to diffuse light occurring from the light source.

So far, the drum type washing machine was explained as an example of the clothes handling apparatus. However, the button for a control panel assembly may be applied not only to the drum type washing machine, but also to various clothes handling apparatuses such as a clothes drier, a drum type washing machine for dual use as a clothes drier, or a combination type washing system, or a refresher.

The button for a control panel assembly is not limited to the clothes handling apparatus formed of stainless steel, and has to be understood as a minimum technique of the present invention, or each kind of buttons for a control panel assembly to which the present invention may be applied.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A button for a control panel assembly that includes a control panel having a button hole to mount the button and a display window, the button comprising:

a pressing portion having an optical diffusion portion for diffusing light from a light source disposed at a back of the button, wherein the optical diffusion portion of the pressing portion has a lattice structure having a plurality of cavities at a front surface of the pressing portion, and wherein an optical shielding member for shielding a part of light from a light source installed at a back of the pressing portion is further provided at a front surface of the optical diffusion portion, wherein the optical diffusion portion having the lattice structure includes the plurality of cavities, and a plurality of barriers formed between the cavities such that some of the light is scattered by the barriers, thereby providing light to a user.

2. The button of claim 1, further comprising:

a mounting portion for attaching the button to a back of the control panel; and a supporting portion for connecting the pressing portion to the mounting portion, and the supporting portion to provide an elastic force to the pressing portion.

3. The button of claim 1, wherein the plurality of cavities of the optical diffusion portion have a square or hexagonal shape.

4. The button of claim 1, wherein the pressing portion includes an outline spaced from an edge of the optical diffusion portion, and the pressing portion encompasses the optical diffusion portion.

5. The button of claim 4, wherein the optical diffusion portion is more concaved than the outline of the pressing portion.

6. The button of claim 1, wherein the optical shielding member is fondled of stainless steel.

7. The button of claim 1, wherein an edge of the optical shielding member is spaced from an outline of the pressing portion.

8. The button of claim 6, wherein the optical shielding member is attached to a front surface of the pressing portion by a double-sided tape.

9. The button of claim 1, wherein a switch contact portion is provided at a side of the pressing portion, the switch contact portion for pressing a switch disposed at a back of the pressing portion when the pressing portion is pressed.

10. A clothes handling apparatus having a control panel assembly comprising:

a plurality of buttons for selecting each kind of functions;

a display for displaying each kind of information;

a control panel having a plurality of button holes for receiving the plurality of buttons, and a display window for installing the display; and a circuit board disposed in the control panel, the circuit board to process control signals inputted through the buttons, wherein at least one of the buttons comprises a pressing portion having an optical diffusion portion for diffusing light occurring from a light source disposed at a back of the buttons, wherein the optical diffusion portion of the pressing portion has a lattice structure having a plurality of cavities at a front surface of the pressing portion, and an optical shielding member is provided at a front surface of the optical diffusion portion for shielding a part of light from the light source at a back of the pressing portion, wherein the optical diffusion portion having the lattice structure includes the plurality of cavities, and a plurality of barriers formed between the cavities such that some of the light is scattered by the barriers, thereby providing light to a user.

11. The clothes handling apparatus of claim 10, further comprising:

a mounting portion for attaching the buttons to components mounted to a back of the control panel; and a supporting portion for connecting the pressing portion to the mounting portion, and the supporting portion to provide an elastic force to the pressing portion.

12. The clothes handling apparatus of claim 10, wherein the optical shielding member is formed of stainless steel.

13. The clothes handling apparatus of claim 12, wherein functions of the clothes handling apparatus that can be selected by a user are displayed on a surface of the optical shielding member.

14. The clothes handling apparatus of claim 13, wherein the functions are penetratingly formed on the surface of the optical shielding member.

15. The clothes handling apparatus of claim 10, wherein a switch contact portion is provided at a side of the pressing portion, the switch contact portion for pressing a switch disposed at a back of the pressing portion when the pressing portion is pressed.

16. A clothes handling apparatus having a control panel assembly comprising:

a plurality of buttons for selecting each kind of functions;

a display for displaying each kind of information;

a control panel having a plurality of button holes for receiving the plurality of buttons, and a display window for installing the display; and a circuit board disposed in the control panel, the circuit board to process control signals inputted through the buttons, wherein at least one of the buttons comprises:

a pressing portion having an optical diffusion portion for diffusing light from a light source disposed at a back of the buttons;

a mounting portion for attaching the buttons to components mounted to a back of the control panel; and a supporting portion for connecting the pressing portion to the mounting portion, and the supporting portion to provide an elastic force to the pressing portion, wherein other parts other than a gap between an outline of the pressing portion to encompass the optical diffusion portion and an edge of the optical diffusion portion are covered with stainless steel, wherein the optical diffusion portion of the pressing portion has a lattice structure having a plurality of cavities at a front surface of the pressing portion, and an optical shielding member is provided at a front surface of the optical diffusion portion, the optical shielding member for shielding a part of light occurring from the light source at a back of the pressing portion, wherein the optical diffusion portion having the lattice structure includes a plurality of cavities, and a plurality of barriers formed between the cavities and thus some of the light is scattered by the barriers, thereby providing light to a user.

* * * * *